US005789070A

United States Patent [19]

Shaw-Klein et al.

[11] Patent Number: 5,789,070

[45] Date of Patent: Aug. 4, 1998

[54] INKJET INK IMAGE RECORDING ELEMENTS WITH CATIONICALLY MODIFIED CELLULOSE ETHER LAYERS

[75] Inventors: Lori Shaw-Klein, Rochester; William A. Light, Victor, both of N.Y.

[73] Assignee: Eastman Kodak Company, Rochester, N.Y.

[21] Appl. No.: 763,808

[22] Filed: Dec. 11, 1996

[51] Int. Cl.[6] ..... B41M 5/00

[52] U.S. Cl. ..... 428/216; 428/195; 428/323; 428/478.2; 428/478.4; 428/480; 428/500; 428/522; 428/532

[58] Field of Search ..... 428/478.2, 195, 428/532, 216, 323, 478.4, 480, 500, 522

[56] References Cited

U.S. PATENT DOCUMENTS

| | | | |
|---|---|---|---|
| 4,239,543 | 12/1980 | Beasley | 106/22 |
| 4,381,946 | 5/1983 | Uehara et al. | 106/22 |
| 4,781,758 | 11/1988 | Gendler et al. | 106/22 |
| 5,352,736 | 10/1994 | Stofko, Jr. et al. | 428/331 |
| 5,474,843 | 12/1995 | Lambert et al. | 428/327 |

FOREIGN PATENT DOCUMENTS

0709221 A1 5/1996 European Pat. Off. .

*Primary Examiner*—Pamela R. Schwartz
*Attorney, Agent, or Firm*—John R. Everett

[57] ABSTRACT

There is disclosed an image recording element for inkjet ink images comprising, in the following order, a support, a base layer and a top layer, wherein:

the base layer comprises a hydrophilic material;

the top layer is ink receptive and comprises a cationically modified cellulose ether having the structure:

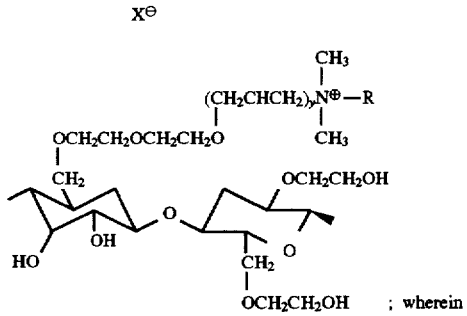

; wherein

R represents $C_nH_{2n+1}$;
X represents halide; and
n is 1 to 30.

7 Claims, No Drawings

INKJET INK IMAGE RECORDING ELEMENTS WITH CATIONICALLY MODIFIED CELLULOSE ETHER LAYERS

FIELD OF THE INVENTION

This invention relates to inkjet ink imaging, particularly inkjet ink image recording elements.

BACKGROUND

In a typical inkjet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol or a polyhydric alcohol or a mixed solvent of water and other water miscible solvents such as a monohydric alcohol or a polyhydric alcohol.

The recording elements typically comprise a support or a support material having on at least one surface thereof an ink-receiving or image-forming layer. The elements include those intended for reflection viewing, which usually have an opaque support, and those intended for viewing by transmitted light, which usually have a transparent support.

While a wide variety of different types of image-recording elements for use with inkjet ink devices have been proposed heretofore, there are many unsolved problems in the art and many deficiencies in the known products which have severely limited their commercial usefulness. The requirements for an image-recording medium or element for ink-jet recording are very demanding.

It is well known that in order to achieve and maintain photographic-quality images on such an image-recording element, the recording element must:

- Be readily wetted so there is no puddling, i.e. coalescence of adjacent ink dots, which leads to nonuniform density.
- Exhibit no image bleeding.
- Exhibit the ability to absorb high concentrations of ink and dry quickly to avoid elements blocking together when stacked against subsequent prints or other surfaces.
- Provide a high level of gloss and be sufficiently insoluble in typical ink solvents to avoid development of differential gloss.
- Exhibit no discontinuities or defects due to interactions between the support and/or layer(s), such as cracking, repellencies, comb lines and the like.
- Not allow unabsorbed dyes should not aggregate at the free surface causing dye crystallization, which results in bloom or bronzing effects in the imaged areas.
- Be optimized image fastness to avoid fade from contact with water or radiation by daylight, tungsten light, or fluorescent light.

EPA 0 709 221 A1 discloses a paper substrate bearing an ink receptive coating. The ink receptive coating contains polyvinylpyrrolidone, an acrylic copolymer, and a quaternized acrylate copolymer hydroxyethyl cellulose and hydroxypropyl methyl cellulose, polyvinyl alcohol and vinyl pyrrolidone copolymer. In photographic quality printing, involving heavy ink laydowns, use of these layers result in offset and blocking.

SUMMARY OF THE INVENTION

The present invention provides an image recording element for inkjet ink images comprising, in the following order, a support, a base layer and a top layer, wherein:

the base layer comprises a hydrophilic material;

the top layer is ink receptive and comprises a cationically modified cellulose ether having the structure:

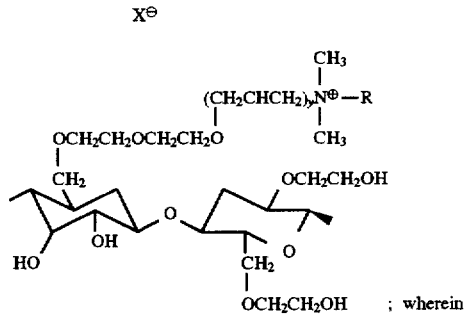

; wherein wherein

R represents $C_nH_{2n+1}$;

X represent halide; and n is 1 to 30.

In general, it is preferable for improved offset to have an alkyl group which is as hydrophobic as possible, for example while n=1 is a useful compound for inkjet applications, n=12 is preferred in most direct comparisons as shown in the examples.

The image recording elements of this invention exhibit a high degree of gloss, dry quickly, and exhibit no blocking or offset under the demanding conditions (high ink laydown) of photographic quality printing. Imaged elements exhibit adequate water and light fastness for typical printing dyes. Further, the elements can be manufactured with ease at low cost due to simplicity of design and avoidance of crosslinking or other chemistries that require extra drying capacity in manufacturing operations.

DETAILS OF THE INVENTION

In the present invention, the recording element can be opaque, translucent, or transparent. Thus, the supports utilized in the recording element of the present invention are not particularly limited and various supports may be employed. Accordingly, plain papers, resin-coated papers, various plastics including a polyester-type resin such as poly(ethylene terephthalate), poly(ethylene naphthalate) and polyester diacetate, a polycarbonate-type resin, a fluorine-type resin such as ETFE, metal foil, various glass materials, and the like can be employed as supports. When the supports of the present invention are transparent, a transparent recording element can be obtained and used as a transparency in an overhead projector.

The supports employed in the present invention must be self-supporting. By "self-supporting" is meant a support material such as a sheet of film that is capable of independent existence in the absence of a supporting support.

The thickness of the support can be 12 to 500 μm, usually 75 to 300 μm.

If desired, in order to improve the adhesion of the base layer to the support, the surface of the support may be corona-discharge-treated prior to applying the solvent-absorbing layer to the support or, alternatively, an undercoating, such as a layer formed from a halogenated phenol or a partially hydrolyzed vinyl chloride-vinyl acetate copolymer can be applied to the surface of the support.

The base layer is primarily intended as a sponge layer for the absorption of ink solvent. As such, it is primarily composed of hydrophilic or porous materials. It has a thickness of 3 to 20 μm.

Hydrophilic materials include gelatin, acetylated gelatin, phthalated gelatin, oxidized gelatin, chitosan, poly(alkylene oxide), poly(vinyl alcohol), modified poly(vinyl alcohol), sulfonated polyester, partially hydrolyzed poly(vinylacetate/vinyl alcohol), poly(acrylic acid), poly(1-vinylpyrrolidone), poly(sodium styrene sulfonate), poly(2-acrylamido-2-methane sulfonic acid), and polyacrylamide and mixtures of these materials. Copolymers of these polymers with hydrophobic monomers may also be used.

Other materials useful in the base layer include cellulose derivatives, gum derivatives, chitin starch, or other materials which are obvious to those skilled in the art.

A porous structure may be introduced into the base layer by the addition of ceramic or hard polymeric particulates, by foaming or blowing during coating, or by inducing phase separation in the layer through introduction of nonsolvent. In general, it is sufficient for the base layer to be hydrophilic, but not porous. This is especially true for photographic quality prints, in which porosity may cause a loss in gloss. Optionally, rigidity may be imparted to the base layer through incorporation of a second phase such as polyesters, poly(methacrylates), polyvinyl benzene-containing copolymers and the like.

The base layer may be pH adjusted to optimize swelling (water capacity), to enhance gloss or to minimize dye migration. For example, in one embodiment of the invention, the pH of the layer is reduced to 3.5 to improve swelling capacity, thereby reducing ink drying times, and to impart waterfastness. In another embodiment, the pH of the image recording layer is raised to 8.5 in order to enhance gloss and reduce bronzing due to surface dye crystallization.

In the preferred embodiment of this invention, the base layer is comprised of 50%–100% photographic-grade gelatin, modified such that the pH is far from the isoelectric point of such a gelatin, in order that water uptake may be maximized. The remainder of the layer may consist of a polymer or inorganic material compatible with said gelatin which does not adversely impact functional properties.

In yet another embodiment, a mordant may be added in small quantities (2%–10% by weight of the base layer) to further improve waterfastness. Useful mordants are disclosed in U.S. Pat. No. 5,474,843.

In particular, the base layer may consist of any hydrophilic polymer or combination of polymers with or without additives as is well known in the art.

The top layer contains 5 to 100 weight percent of the specified cationically modified cellulose ether.

While image recording elements formed solely of the cationically modified cellulose ether polymer alone provide high utility, other compatible polymers, and/or fillers, may be added to enhance particular performance aspects dependent on the end use of the image recording layer. Polymers which are compatible over some range which may be used include but are not limited to nonionic cellulose ethers, anionic cellulose ethers, polyvinyl alcohol, sulfonated polyesters, polyvinylpyrrolidone and the like.

Useful cationically modified cellulose ether polymers include Celquat SC240C (hydroxyethyl cellulose reacted with trimethylammonium chloride substituted epoxide; National Starch and Chemical) and Quatrisoft LM-200 (hydroxyethyl cellulose reacted with a dodecyl dimethylammonium chloride substituted epoxide; Amerchol Corp.). A combination of A4M (methyl cellulose) and JR400 (hydroxyethyl cellulose reacted with a trimethyl ammonium chloride substituted epoxide) in a weight ratio of 80/20 provides another useful example of materials useful in forming the image recording layer.

The top layer has a thickness of 0.1 to 2.0 μm.

Since the image recording element may come in contact with other image recording articles or the drive or transport mechanisms of the image recording devices for which its use is intended, additives such as surfactants, lubricants, matte particles and the like may be optionally added the element to the extent that they do not degrade properties of interest.

The layers described above, including the base layer and the top layer, may be coated by conventional coating means onto a transparent or opaque support material commonly used in this art. Coating methods may include, but are not limited to wound wire rod coating, slot coating, slide hopper coating, gravure, curtain coating and the like. Some of these methods allow for simultaneous coatings of both layers, which is preferred from a manufacturing economic perspective.

The inks used to image the recording elements used in the present invention are well-known inks. The ink compositions used in ink-jet printing typically are liquid compositions comprising a solvent or carrier liquid, dyes or pigments, humectants, organic solvents, detergents, thickeners, preservatives, and the like. The solvent or carrier liquid can be comprised solely of water or can be predominately water mixed with other water-miscible solvents such as polyhydric alcohols, although inks in which organic materials such as polyhydric alcohols are the predominant carrier or solvent liquid also may be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758.

Although the recording elements disclosed herein have been referred to primarily as being useful for ink-jet printers, they also can be used as recording media for pen plotter assemblies. Pen plotters operate by writing directly on the surface of a recording medium using a pen consisting of a bundle of capillary tubes in contact with an ink reservoir.

The following examples further illustrate the invention and the benefits flowing therefrom.

EXAMPLES

The following image recording elements were prepared by slot coating. The base layers were coated from a 10% solids aqueous formulation directly on corona discharge treated photographic-grade polyethylene coated paper and dried thoroughly at 100° C. The final dry coverage of the base layers is 5.4 g/m$^2$. The image recording layers were coated directly over the base layer in a second pass from coating formulations ranging from 1 to 2% solids. The latter layers were dried under identical conditions to the base layer. The dry coverage of the image receiving layers is 1.1 g/m$^2$.

In each of the following examples, the base layer comprises a combination of 50% by weight lime-process ossein photographic grade gelatin, 50% polyvinylpyrrolidone (PVP K-90, ISP). The pH of the coating formulation was adjusted to 3.5 by direct addition of hydrochloric acid (36–38%, JT Baker). Some surfactant (Dixie Chemicals 10G) was added to enhance coatability.

Gloss was measured at an angle of 60 degrees to the perpendicular to the plane of the coating using a Microgloss portable glossmeter (Paul N. Gardner Co. Inc.) according to ASTM standard D 523.

Apparent dry time for printed ink was evaluated by printing continuous bars of black, cyan, magenta, yellow, red, green and/or blue using an inkjet printer of interest in a controlled atmosphere of 70 degrees F., 80% relative humidity. Immediately after the printed sheet is ejected from the printer, it is placed face up on a foam rubber mat. A standard piece of bond paper (Hammermill) is placed over the printed area and a smooth metal cylinder (mass 1.75 kg) is rolled quickly but smoothly and continuously over the bond paper surface. The bond paper is immediately separated from the printed page of interest. The time to print the strips is known (typically 3 to 5 minutes, depending on the printer), so that if the last-printed edge of the sheet is taken as "zero minutes", an arbitrary time of, for example, two minutes may be chosen for comparative purposes. The optical density of the ink transferred to the bond paper is measured at that point. In such a way, the relative transfer of ink to bond paper may be directly compared for several experimental samples. A low optical density of transferred ink (0.02 or less) would thereby indicate a nearly dry print sample, and hence an experimental coating which exhibits short dry times.

Waterfastness of print samples is evaluated by printing blocks of black, cyan, magenta and/or yellow ink, measuring their optical densities, submerging the blocks in deionized water at room temperature with light agitation for 5 minutes, removing the samples from the water, allowing them to dry, and remeasuring the optical densities. The percent loss in optical density for each color may then be calculated directly.

The following examples further clarify the invention.

Examples 1 & 2, Comparative Examples A–D

The following coatings were made over a base layer as described above and printed using a Hewlett-Packard 850C (Hewlett Packard Inc.) inkjet printer at 300×600 dpi. The gloss for the unprinted (W) region and the various colors (C,M,Y,R,G,B) is recorded below.

| Example | Composition | W | C | M | Y | R | G | B |
|---|---|---|---|---|---|---|---|---|
| 1 | SC240C | 83 | 80 | 81 | 66 | 81 | 81 | 80 |
| 2 | LM200 | 88 | 81 | 82 | 76 | 76 | 76 | 82 |
| A | A4M | 89 | 15 | 88 | 83 | 76 | 33 | 67 |
| B | PVA | 87 | 50 | 54 | 60 | 56 | 52 | 52 |
| C | CMC | 17 | 35 | 62 | 56 | 78 | 54 | 44 |
| D | Composition D** | 11 | 15 | 22 | 19 | 23 | 23 | 20 |

SC240C: Hydroxyethyl cellulose reacted with trimethylammonium chloride substituted epoxide (Celquat SC240C, National Starch and Chemical)

LM200: Hydroxyethyl cellulose reacted with a dodecyl dimethylammonium chloride substituted epoxide(Quatrisoft LM-200, Amerchol Corp.)

A4M: Methyl cellulose (Methocel A4M, Dow Chemical)

CMC: Sodium salt of carboxymethyl cellulose, medium viscosity (Sigma Chemical Co.)

PVA: Polyvinyl alcohol (Elvanol 52/22, DuPont) **Composition D: Image receiving layer of the similar composition to the layer described in Example IX, U.S. Pat. No. 5,137,773: 35 weight % Polyethylene Oxide (Polyox WSRN 750, Union Carbide); 30 weight % hydroxypropyl methylcellulose (Methocel K100, Dow Chemical); 20 weight % hydroxyethyl cellulose reacted with a trimethyl ammonium chloride functionalized epoxide (Ucare JR400, Amerchol Corp.); 15 weight % poly (2-acrylamido-2-methyl-1-propane sulfonic acid) (Aldrich)

This data shows the superior gloss of image recording elements of the current invention over those typically used for inkjet recording element.

Examples 3, 4; Comparative Examples E, F, G

The following coatings were coated over a base layer as described previously and printed at 720 dpi using an Epson Stylus Color 500 printer. In this case, gloss in the printed black area is also recorded (K).

| Ex | Comp | W | K | C | M | Y | R | G | B |
|---|---|---|---|---|---|---|---|---|---|
| 3 | SC240C | 78 | 90 | 77 | 80 | 79 | 77 | 75 | 76 |
| 4 | LM200 | 87 | 90 | 81 | 82 | 84 | 82 | 80 | 80 |
| E | CMC | 78 | 62 | 17 | 59 | 43 | 48 | 14 | 19 |
| F | Cel L200 | 90 | 84 | 35 | 82 | 79 | 65 | 22 | 36 |
| G | Composition D** | 10 | 8 | 9 | 13 | 11 | 20 | 15 | 25 |

Cel L200: Copolymer of diallyldimethyl ammonium chloride and hydroxyethyl cellulose (Celquat L200, National Starch and Chemical)

This data shows that the gloss of image recording elements of the current invention exceeds that of other ionically modified cellulosics which could be contemplated as components of inkjet recording layer(s).

Examples 5–6; Comparative Examples H, I, J

Image recording elements were coated over a gelatin/polyvinyl pyrrolidone (pH 3.5) layer as described previously. A dry time test as described above was conducted using an Epson Stylus Color 500 inkjet printer at 720 dpi. The optical density of the transferred ink was calculated by measuring the value at the two-minute point and subtracting the optical density of the unprinted portion of the bond paper (typically 0.10).

Results are summarized below.

| Ex | Comp | K | C | M | Y | R | G | B |
|---|---|---|---|---|---|---|---|---|
| 5 | SC240C | 0.02 | 0.0 | 0.0 | 0.02 | 0.0 | 0.01 | 0.03 |
| 6 | LM200 | 0.04 | 0.0 | 0.0 | 0.0 | 0.0 | 0.0 | 0.0 |
| H | HEC | 0.09 | 0.02 | 0.02 | 0.08 | 0.01 | 0.05 | 0.08 |
| I | A4M | 0.04 | 0.03 | 0.0 | 0.01 | 0.0 | 0.04 | 0.04 |
| J | CMC | 0.30 | 0.09 | 0.05 | 0.05 | 0.06 | 0.15 | 0.20 |

HEC: Hydroxyethyl cellulose (Cellosize QP4400H, Union Carbide)

These examples show that the compositions of this invention yield good dry times as reflected by transfer of ink to bond paper when compared to other derivatives of cellulosic compounds.

Example 7, Comparative Examples K, L

Image recording elements were produced as described above over gelatin/PVP pH 3.5. Cyan areas were produced using an Epson Stylus Color Pro printer at 720 dpi. Waterfastness was evaluated using the procedure described previously. The percent loss in optical density is recorded below.

| Example | Composition | % Loss in Cyan density |
|---|---|---|
| 7 | A4M/JR400 | 0% |
| K | A4M | 32% |
| L | HEC | 15% |

A4M/JR400: A combination of A4M (methyl cellulose) and JR400 (hydroxyethyl cellulose reacted with a trimethyl ammonium chloride substituted epoxide) in a weight ratio of 80/20.

This example shows the potential for superior waterfastness which can be expected for the image recording elements of this invention when compared with nonionic cellulose ethers. This effect is clear even at low concentrations of such materials.

Examples 8–12

The following examples illustrate the effect of varying the base layer composition while maintaining the image receiving layer composition. For each of the following examples, the base coat composition was coated in the manner described previously from a 10% solids solution directly over corona discharge treated polyolefin coated photographic paper. Subsequently, the image receiving layer composition was applied from a 1.25% solids aqueous solution at a dry coverage of 1.1 g/m2. In each case, the image receiving layer comprises hydroxyethylcellulose reacted with trimethylammonium chloride substituted epoxide (Ucare JR400, Amerchol).

| Example | Base composition, weight ratio | Base pH adjustment? | Gloss, white (unprinted) area |
|---|---|---|---|
| 8 | gelatin | 3.5, by HCl | 91 |
| 9 | gelatin/PVP, 50/50 | 3.5, by HCl | 90 |
| 10 | gelatin/chitosan, 95/5 | 3.0, by HCl | 92 |
| 11 | gelatin/JR400, 95/5 | none | 91 |
| 12 | gelatin/LM200, 95/5 | none | 91 |

These examples illustrate the variety of base layer additives which may be successfully used in combination with the image recording elements of this invention while maintaining the high degree of gloss desirable for photographic-quality inkjet imaging applications.

This invention has been described with particular reference to preferred embodiments thereof but it will be understood that modifications can be made within the spirit and scope of the invention.

We claim:

1. An image recording element for inkjet ink images comprising, in the following order, a support, a base layer and a top layer, wherein:

the base layer comprises a hydrophilic material;

the top layer is ink receptive and comprises a cationically modified cellulose ether having the structure:

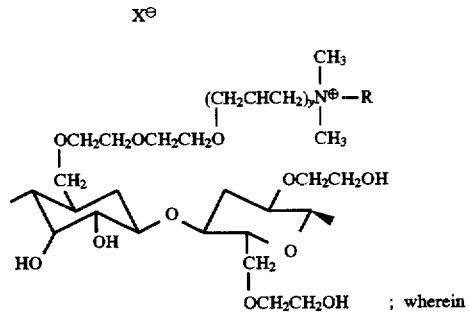

; wherein

R represents $C_nH_{2n+1}$;

X represent halide; and n is 1 to 30.

2. The element of claim 1 wherein n is 1–12 and X is chloride.

3. The element of claim 2 wherein the cationically modified cellulose ether is selected from the group consisting of (a) hydroxyethyl cellulose reacted with trimethylammonium chloride substituted epoxide and(b) hydroxyethyl cellulose reacted with a dodecyl dimethylammonium chloride substituted epoxide.

4. The element of claim 1 wherein the base layer is selected from the group of materials consisting of gelatin, acetylated gelatin, phthalated gelatin, oxidized gelatin, chitosan, poly(alkylene oxide), poly(vinyl alcohol), modified poly(vinyl alcohol), sulfonated polyester, partially hydrolyzed poly(vinylacetate/vinyl alcohol), poly(acrylic acid), poly(1-vinylpyrrolidone), poly(sodium styrene sulfonate), poly(2-acrylamido-2-methane sulfonic acid), and polyacrylamide and mixtures of these materials.

5. The element of claim 4 wherein the base layer comprises gelatin.

6. The element of claim 1 wherein the base layer has a thickness of 3 to 20 μm and the top layer has a thickness of 0.1 to 2 μm.

7. The element of claim 1 wherein the base layer, the top layer or both include matte particles.

* * * * *